US007101410B1

(12) United States Patent
Baugh et al.

(10) Patent No.: US 7,101,410 B1
(45) Date of Patent: Sep. 5, 2006

(54) METHOD FOR THE MICROBIOLOGICAL DESULFURIZATION OF FOSSIL FUELS

(76) Inventors: Clarence L. Baugh, 2084 Deer Creek Country Club Blvd., Deerfield Beach, FL (US) 33442; Thomas E. Baugh, 8535 Boca Rio Dr., Boca Raton, FL (US) 33487; Robert L. Baugh, 902 Clint Moore Rd., Suite 208, Boca Raton, FL (US) 33487

( * ) Notice: Subject to any disclaimer, the term of this patent is extended or adjusted under 35 U.S.C. 154(b) by 16 days.

(21) Appl. No.: 10/859,113

(22) Filed: Jun. 3, 2004

(51) Int. Cl.
*C10L 10/00* (2006.01)
*C10G 31/00* (2006.01)

(52) U.S. Cl. ..... 44/622; 44/621; 44/624; 435/282; 435/281

(58) Field of Classification Search ..... 44/622; 435/282
See application file for complete search history.

(56) References Cited

U.S. PATENT DOCUMENTS 4,562,156 A 12/1985 Isbister et al.
4,851,350 A 7/1989 Stevens, Jr. et al.
4,861,723 A 8/1989 Madgavkar
5,358,869 A 10/1994 Kilbane
5,358,870 A * 10/1994 Monticello et al. ..... 435/282
5,510,265 A 4/1996 Monticello
5,593,889 A 1/1997 Valentine
5,789,236 A 8/1998 Jenneman
5,804,435 A 9/1998 Kurane et al.
6,071,738 A 6/2000 Johnson et al.
6,124,130 A 9/2000 Olson

* cited by examiner

*Primary Examiner*—Vasu Jagannathan
*Assistant Examiner*—Sandra K. Poulos
(74) *Attorney, Agent, or Firm*—C. J. Husar

(57) ABSTRACT

A microbiological method of desulfurization (MDS) of hydrocarbon fuels such as coal, coal tar and petroleum uses an aqueous microbial biocatalytic agent which is not significantly reproducing but is still capable of oxidizing inorganic sulfur compounds and/or of selectively cleaving sulfur-carbon bonds in organic compounds, thereby removing sulfur with insignificant losses in fuel value. Microorganisms are selected according to the type of fuel sulfur present and the environment in which the desulfurizing process is to take place. One embodiment allows droplets of highly concentrated cell-water suspensions to pass from the top surface of the fuel through to the bottom, desulfurizing along the way and removing the sulfur products of the process as well. This MDS method can be used during hydrocarbon fuel production, storage, transport, and/or processing conditions, thereby also providing an added benefit in corrosion protection of the vessels used for these functions.

42 Claims, No Drawings

METHOD FOR THE MICROBIOLOGICAL DESULFURIZATION OF FOSSIL FUELS

FIELD OF THE INVENTION

The present invention relates to a microbiological method of desulfurization (MDS) of fossil fuels, such as coal, coal tar and petroleum, which contain either or both organic and inorganic (pyritic) sulfur. The method depends on an aqueous microbial catalytic agent which is not significantly reproducing but is still capable of oxidizing inorganic sulfur compounds and/or of selectively cleaving sulfur-carbon bonds in organic compounds.

The present invention describes a microbiological method of desulfurization (MDS) of hydrocarbon fuels without an unacceptable loss in the fossil fuel value due to catabolic destruction of the hydrocarbon. The catabolic destruction is prevented as the growth of the microbes is inhibited or greatly reduced by selective conditions chosen to allow also the biocatalytic removal of both inorganic and organic sulfur as needed. Further, the present invention can be used under hydrocarbon fuel production, storage, transport, and/or processing conditions. This invention therefore also provides an added benefit in corrosion protection of the vessels used for these functions.

BACKGROUND OF THE INVENTION

Sulfur is nearly ubiquitous in fossil fuels and occurs as inorganic (pyritic) sulfur and organic sulfur (mercaptans, disulfides, thiols, sulfones, thioethers, thiophenes) and many more complex forms of "bound" sulfur. In petroleum, it is the third most abundant element after carbon and hydrogen, and yet it is an undesirable component of both raw and refined fuels. The sulfur concentration of petroleum has been correlated with the corrosion of pipelines, pumps, and refining equipment and leads to the premature breakdown of engines. In addition, combustion of sulfur-containing fuels results in sulfur dioxide pollution of the atmosphere, contributing to acid rain. Consequently, strict regulations on sulfur emissions and the sulfur content of refined fuels have been adopted in the U.S. and elsewhere.

When the sulfur is predominantly in the organic form it can be removed chemically by a hydrodesulfurization process which involves reacting the hydrocarbon with hydrogen gas in the presence of a catalyst at elevated temperatures. Since the hydrodesulfurization process has many shortcomings and is quite expensive, microbial desulfurization (MDS) processes have attracted much attention.

Many processes utilizing microorganisms known to be capable of both degrading sulfur compounds and utilizing hydrocarbon for growth have been studied with varying degrees of success. However to date, Microbial Desulfurization has been shown to be effective only in laboratory experiments. Further, it has been suggested that current Microbial Desulfurization processes are, for the most part, merely incidental to the metabolic consumption of the hydrocarbon by the microorganisms during their growth process (catabolic MDS) rather than sulfur specific or sulfur selective reactions.

Sulfur content of carbonaceous fuels, such as coals and oils, has prevented utilization of a considerable amount of such materials due to deleterious effect upon the environment. Inorganic pyritic sulfur and organically bound sulfur may each constitute as much as about 3.5 weight percent of the coal. Microbial metabolism of inorganic pyritic sulfur by its oxidation using bacteria such as *Thiobacillus* and *Sulfolobus* species is known (Eligwe, C. A., "Microbial Desulfurization of Coal," Fuel, 67: 451–458 (1988)). These chemolithotropic organisms utilize inorganic pyritic sulfur compounds as energy sources and are capable of removing 90% or more of the inorganic pyritic sulfur from coal within a few days.

Pre-combustion MDS for coal and liquid petroleum products has been described in, for example, U.S. Pat. No. 4,861,723 pyrite removal during wet grinding of coal with MDS organisms; U.S. Pat. No. 4,851,350 organic sulfur removal in coal slurry with added nutrients and *Hansenula* sp. or *Cryptococcus albidus*; and U.S. Pat. No. 5,510,265 for removal of organic sulfur by *Rhodococcus* species and their enzyme derivatives in combination with hydrodesulfurization (HDS). MDS in these cases is specific to removal of either pyritic or organic sulfur but not both during active processing of the fuel sources.

Valentine in U.S. Pat. No. 5,593,889 suggests use of MDS at any time during storage, transport, and processing of hydrocarbon fuels. However, the MDS process in '889 converts organic sulfur to water-soluble sulfates in an emulsion under growth conditions with supplemental nutrients.

Dibenzothiophene (DBT) is the organosulfur compound most considered representative of the form in which organic sulfur exists in naturally occurring organic carbonaceous fuels such as coal and oil and is the primary compound upon which the microbial metabolism of organosulfur compounds has focused. The pathway of microbial degradation of DBT in most of the prior art is by C—C bond cleavage. Microbial degradation of organic sulfur-containing carbonaceous materials by C—C bond cleavage results in the loss of a large portion of the calorific value of the carbonaceous fuel. It is, therefore, desirable to follow a microbial degradation route which removes sulfur from the molecule without removing carbon from the molecule, thereby retaining calorific value of the fuel to a greater degree than is possible by carbon degradative pathways. Such sulfur-specific metabolism of the organic substrates requires cleavage of carbon-sulfur bonds in the organic sulfur-containing molecule. In the case of sulfur specific metabolism of dibenzothiophene, the organic end product is 2-hydroxybiphenyl.

Prior art microorganisms alleged to be capable of degradation of DBT by C—S cleavage to sulfates include a *Pseudomonas* species as described by Isbister, et al. (Isbister, J. D. and Kobylinski, E. A., "Microbial Desulfurization of Coal in Processing and Utilization of High Sulfur Coals," Coal Science and Technology Series, No. 9, 627); *Rhodococcus rhodochrous* and *Bacillus sphaericus* as disclosed by Kilbane, II, in U.S. Pat. No. 5,358,869; and *Pseudomonas* ATCC 39381 as set forth by Isbister, J. D., and R. C. Doyle in U.S. Pat. No. 4,562,156. However these organisms are intended for organic, not pyritic, sulfur removal under growth nutrient supplemented conditions and/or agitated aqueous emulsion conditions.

Johnson et al. in U.S. Pat. No. 6,071,738 disclose the use of recombinant microorganisms to remove organic sulfur by metabolic processing to organosulfinate and/or organosulfonate precipitates. These compounds are then extracted by a polar solvent and removed by phase separation using a polar phase such as water. Microorganisms or enzymes employed as biocatalysts in '738 are reported not to consume the hydrocarbon framework of the former refractory organosulfur compound as a carbon source for growth. As a result, the fuel value of substrate fossil fuels thus treated does not deteriorate. The concentrations of microorganisms or derived enzyme biocatalyst can be adjusted so that appropriate volumes of biocatalyst preparations having predetermined activities can be obtained. However these organisms are intended only for organic, not pyritic, sulfur removal. Further, use is described as under bioreactor or refinery type conditions.

Similarly Olson in U.S. Pat. No. 6,124,130 describes microbial desulfurization of hydrocarbon fuel without the fuel being used as a carbon or energy source. However at least a 500-fold growth of the culture is expected per week using a sulfur free added alternative carbon source in a supplemented innoculum.

U.S. Pat. No. 5,804,435 describes a *Pseudomonas putida* that is resistant to organic solvents and hence can be used for biodesulfurization with a very small amount of water. These microorganisms are organic solvent-resistant strains capable of performing desulfurization under microaerobic conditions in the presence of organic solvents. The application of these microorganisms to petroleum refining or coal desulfurization steps is suggested to establish a more efficient, energy-saving and safe desulfurization process. However no specific method of use is suggested.

Jenneman et al. in U.S. Pat. No. 5,789,236 describe the use of concentrated *Campylobacter* sp. on oil to speed up a reduction of sulfides process in fuel reservoirs. One example uses a microbe innoculum concentration of $10^7$/ml. of nutrient supplemented culture medium.

Hence it is clear that none of the prior MDS art describes a microbiological method of desulfurization of fossil fuels (MDS) allowing the biocatalytic removal of sulfur without an unacceptable loss in the fossil fuel value due to catabolic destruction of the hydrocarbon, without the need for agitation, and without the addition of growth enabling nutrients. Further it is clear that none of the prior MDS art describes a microbiological method of desulfurization of fossil fuels (MDS) allowing the biocatalytic removal of both inorganic and organic sulfur without an unacceptable loss in the fossil fuel value due to catabolic destruction of the hydrocarbon and without the addition of growth enabling nutrients. The present invention therefore provides a new means for more effective and desirable MDS treatment of sulfur-containing hydrocarbon fuels.

OBJECTS OF THE INVENTION

The present invention describes a microbiological method of desulfurization of fossil fuels (MDS) allowing the biocatalytic removal of both inorganic and organic sulfur without an unacceptable loss in the fossil fuel value due to catabolic destruction of the hydrocarbon. This preservation of fuel value is due to the complete or nearly complete inhibition of the growth of the microbes under the novel MDS conditions of the present invention. This is a radical departure from current (MDS) technologies that depend upon the growth of petrophilic organisms and have attempted to provide optimal growth conditions for the microorganisms with the exception of a sulfur supply. These prior technologies seem to reduce the sulfur concentration simply by incorporating it into the cellular biomass.

Hence a primary object of the present invention is to provide a novel MDS method capable of the biocatalytic removal of sulfur from hydrocarbon fuels.

An additional primary object of the present invention is to provide a novel MDS method capable of the biocatalytic removal of both inorganic and organic sulfur.

A further object of the present invention is to provide an MDS method capable of the biocatalytic removal of both inorganic and organic sulfur and having no unacceptable loss in the fossil fuel value due to catabolic destruction of the hydrocarbon.

Yet another object of the present invention is to provide an MDS method in which there is no need for the addition of growth enabling nutrients during the MDS process.

Additionally, an object of the present invention is to provide an MDS method in which there is no need for agitation of the fuel during the MDS process.

Additionally, an object of the present invention is to provide an MDS method in which there is no need for emulsification of the fuel during the MDS process.

Another object of the present invention is to provide for the application of this novel method of MDS to use in vessels and reservoirs during the production, storage, transport, and processing of fossil fuels.

Another object of the present invention is to provide for the application of this novel method of MDS to use in vessels and reservoirs during the mining, storage, transport, and processing of coal products.

SUMMARY OF THE INVENTION

The present invention is a MDS method for microbiologically desulfurizing sulfur containing hydrocarbon fuel through the use of an aqueous biocatalytic agent having the ability to metabolize pyritic and/or organic sulfur compounds. The biocatalytic agent is made up of viable microbial agents consisting of non-growing microbes, minimally growing microbes, and combinations thereof. Hence the sulfur-containing hydrocarbon fuel maintains a fuel value that does not significantly change during desulfurizing. Further the organisms used have the ability to oxidize pyritic sulfur compounds and/or to cleave carbon-sulfur bonds. In some embodiments, as determined by the sulfur contents of the hydrocarbon fuel and the needs of the MDS process, the biocatalytic agent is prepared from a microorganism or a combination of microorganisms that can metabolize both pyritic and organic sulfur compounds.

No added growth enabling nutrients are needed in this novel method of MDS. Neither is there a need for the formation of an emulsion nor for mechanical agitation or stirring.

DESCRIPTION OF THE PREFERRED EMBODIMENTS

Microbial Background

As seen for all organisms, microorganisms such as bacteria, yeast, fungi and algae have certain chemical and physical requirements for growth. These requirements are of particular importance during the isolation and culturing of microorganisms for MDS applications. The basic knowledge of these requirements is especially important in the selection of effective candidate microorganisms for Microbial Desulfurization (MDS).

Chemical Requirements

1. An energy source. This is needed primarily for biosynthetic reactions, to make polymers such as proteins from amino acids and RNA and DNA from nucleotides, cell walls, lipids from glycerol and fatty acids. Some bacteria can utilize light energy. However the microorganisms of greatest interest for the present invention oxidize chemical compounds to obtain their energy. These are called Chemotrophs and are either chemo-organotrophs if they oxidize organic compounds, or chemo-lithotrophs if they oxidize inorganic compounds (such as Hydrogen sulfide) for energy.

2. A carbon source. Carbon is required for all of the polymeric units in the cell such as DNA, RNA, proteins, lipids, peptidoglycan or cell wall material. The bacteria that oxidize inorganic sulfur compounds can utilize carbon dioxide as a sole carbon source. The organisms that utilize organic carbon compounds as their carbon source are called heterotrophs. Heterotrophic organisms that can utilize hydrocarbons are called petrophilic or petroleum loving.

When bacteria utilize hydrocarbon as a carbon source the carbon is changed to new cell mass and a lesser fuel value is caused when a hydrocarbon fuel is the carbon source. On the other hand, when microbial agents do not degrade the carbon skeleton of carbon-sulfur compounds and, instead, transform the carbon skeleton into another molecule that still has fuel value, the hydrocarbon fuel does not have a significant change in fuel value. Such metabolism occurs when the microorganism merely breaks the carbon-sulfur bonds and does not use the resultant energy nor the carbon for growth purposes.

3. A nitrogen source. Bacteria and other microorganisms are very versatile as to their nitrogen source as there are different genera that can use atmospheric nitrogen (gas), ammonia, nitrite, nitrate, and organic nitrogen. Nitrogen is a component in the amino acids of proteins and in the purines and pyrimidines of RNA and DNA.

4. A phosphorus source. Phosphate is a component part of the nucleotides found in RNA and DNA and is also required for energy transfer reactions.

5. A mineral source including sulfur, iron, magnesium, manganese, and many others.

6. A water source.

Physical Requirements

In addition to the chemical requirements above, attention to the following physical requirements is also needed in the selection, isolation, and culturing of microorganisms suitable for use in the present novel MDS method. These requirements include:

1. pH. The proper pH range must be maintained for optimal growth of the organisms when in culture. This optimal pH varies with the microorganisms being considered.

2. Temperature. The temperature is also quite important with 25 degrees centigrade being optimal for most soil bacteria. In most cases, 50% of the metabolic activity is lost for each 10 degree C. reduction under the optimal temperature.

3. Moisture content. The moisture content should be in the 20–25% range for optimal growth.

Biocatalytic Agent

Candidate microorganisms for the biocatalytic agent may be bacteria, yeast, fungi, algae, and combinations thereof. The following is a partial list of microorganisms that can be used. This is somewhat process site specific and will vary according to geographic location and fuel specific sulfur removal needs. That is to say, the organisms to be chosen for use depend upon the chemical nature of the sulfur compounds in the hydrocarbon. For example, West Texas Crude contains a very high level of benzodithiophene. Hence a biocatalyst capable of carbon-sulfur bond cleavage would be useful in metabolizing the benzodithiophene to the organic end product of 2-hydroxybiphenyl. Microorganisms also need to be selected to be compatible with the environmental conditions in which the MDS process is to occur. Hence a match is needed between the pH, temperature, pressure, etc. ranges in which the microorganism can function and the pH, temperature, pressure, etc. ranges present in the MDS process environment.

A partial list of useful microorganisms for inclusion in the biocatalytic agent of the present invention is included here below:

Bacteria:

*Rhodococcus erythropolis, Rhodococcus rhodochrous*, other *Rhodococcus* species

*Nocardia erythropolis, Nocardia corrolina*, other *Nocardia* species

*Pseudomonas putida, Pseudomonas oleovorans*, other *Pseudomonas* species

*Arthrobacter globiformis, Arthobacter Nocardia paraffinae, Arthrobacter paraffineus, Arthrobacter citreus, Arthrobacter luteus*, other *Arthrobacter* species

*Mycobacterium vaccae* JOB and other species of *Mycobacterium*

*Acinetobacter* sp. (rag) and other species of *Acinetobacter*

*Corynebacterium* sp. and other *Corynebacterium* species

*Thiobacillus ferrooxidans, Thiobacillus intermedia*, other species of *Thiobacillus Shewanella* sp.

*Micrococcus cinneabareus*, other *micrococcus* species

*Bacillus sulfasportare* and other *bacillus* species

Fungi:

White wood rot fungi

*Phanerochaete chrysosporium*

*Phanerochaete sordida*

*Trametes trogii*

*Tyromyces palustris* other white wood rot fungal species

*Streptomyces fradiae, Streptomyces globisporus*, and other *Streptomyces* species Yeast:

*Saccharomyces cerrevisiae, Candida* sp., *Cryptococcus albidus* and other yeasts Algae Preparation of the Bio-Catalytic Agent In the present invention, selected microbial cultures are grown to an extremely high population in the laboratory and these laboratory grown organisms are combined into a composite suspension in water to form the biocatalytic agent. Selection of the optimal species of the microbial cultures varies with respect to the presence and concentration of pyritic sulfur and/or organic sulfur in the hydrocarbon fuel, coal product or oil, as well as, other parameters of the hydrocarbon fuel to be desulfurized. Organisms are selected from bacteria, yeast, fungi and algae.

The population of the cell suspension is usually set to a concentration of at least ($1\times10^8$) or ($1\times10^9$) cells per ml of each organism. This concentration of microbes is many fold higher than normally can be obtained by growing the organisms using petroleum or coal-water as a growth medium (carbon and energy source).

Sulfur Containing Hydrocarbon Fuel

The sulfur containing hydrocarbon fuel is selected from the group consisting of fossil fuel, petroleum liquids, petroleum products, oil, coal, coal-water, coal products, coal tar, hydrocarbon fuels, and synthetic hydrocarbon fuels. The form of the fuel can be liquid, solid, suspension, slurry, etc. In practice, any fuel form present during production, storage, transport, processing, etc. can be treated by this method of MDS with appropriate adjustments in the selection of the microorganisms for the biocatalytic agent in order to be best matched to the environment in which the MDS is to take place.

Method of the Invention

In general, the water-cell suspension of the biocatalytic agent is added at the top of the tank or vessel to the surface of the hydrocarbon fuel or petroleum product and allowed to pass through the fuel or down the liquid-solid interface by gravity flow or under pressurized flow. Small drops of the biocatalytic agent are preferred in order to increase the contact surface area of the biocatalytic agent. Any sulfur compound released by the metabolic activity is transferred to the water and carried to the bottom of the tank. The water-cell suspension is allowed to collect in the bottom of the tank and is removed or, if desired, pumped back onto the surface of the fuel and the process is repeated until the desired concentration of sulfur compounds is reached.

In one embodiment, the present MDS process can be utilized on board oil tankers with the sulfur being removed while the ship is in transit. The water is monitored for sulfur compounds and viable microbe counts until the sulfur concentration stabilizes. At that time, if more sulfur needs to be removed, the same or different microbial strains and/or chemical metabolic factors (such as vitamins) may be added as needed. The MDS process can be started when the fuel is placed in the tanker and continued throughout the transit for as long as needed to reach a desired reduction in sulfur content of the fuel.

Similarly in another embodiment, this novel MDS process can be applied to a fuel system at a well head without the need for special equipment and before being piped to a refinery process. In a further embodiment, this novel MDS process can be applied within the system at a coal mine without the need for special equipment and before the mined coal fuel is shipped away.

The cell-water suspension containing the sulfur compounds can be removed from the tank, pipe, or other vessel to separate out the cells for recycling of the cells in water suspension, if so desired, and then to drying equipment for sulfur removal. Also, the temperature and/or the pH of the water, as well as the selection of the microbes to be used, can be adjusted as needed for optimal or increased activity against specific sulfur-containing compounds.

From the above description of this novel MDS method, it can be seen that the present invention does not need the use of emulsions nor of associated emulsion breaking technologies. Further, there is no need for mechanical agitation throughout the process.

Underlying Rationale:

The selected microbial cultures are grown to extremely highly concentrated populations in the laboratory using standard microbiological growth media and then provided to the MDS process. The growth medium is selected so that the concentration of each organism is much higher than can be obtained from growth processes utilizing hydrocarbon as a carbon and energy source.

The microbes are added to a water suspension and adjusted to make such a very high initial population concentration that very little, if any, growth can occur. Although the metabolic conditions are such that very little growth may occur, the metabolic activity of the bacteria is not inhibited and still proceeds. The total metabolic activity is much higher than if the microbes had been allowed to grow from a low concentration innoculum. For example, if the suspension contains $1\times10^4$ cells per ml., the present process would immediately at the start of the process have ten thousand times the number of viable cells per ml as compared to the number achieved in the traditional system. In addition, the bacteria and other microbes that oxidize pyritic sulfur grow so very slowly that it would not be practical to utilize them in a growth process. They can, however, be very effective if they are previously grown to a high concentration population under ideal conditions in the laboratory.

Several means can be used to limit the growth of the microorganism. They may be used in alone or in combinations with each other. The needs of each process environment and the nature of the fuel to be desulfurized are used to determine which of the means would be appropriate for use in a given situation. These means include:

1. No supplemental growth factors are added. The only energy source, carbon source, nitrogen source, phosphate source, and mineral source is that naturally occurring in the hydrocarbon fuel or petroleum. These unbalanced growth conditions severely restrict any microbial growth.

2. The very large population of organisms will limit growth by simple crowding and production of metabolic inhibitors.

3. The pH and temperature can be controlled in order to limit growth and select for desired chemical reactions for catabolizing specific sulfur-containing compounds and/or for metabolic activity under pH and temperatures needed for the environment in which the MDS will be done.

4. Various anti-metabolites can be added, if desired, without harming the fuel value of the hydrocarbon fuel or petroleum product.

EXAMPLES

Example 1, Trial 1

The 4 liters of crude oil were treated with the microbial technique. One hundred milliliters of microorganisms and water were added to the top of the oil by spraying. The water and organisms that went through the oil were taken from the bottom and recycled to the top. The process was repeated daily for two weeks. Very importantly, no nutrients were added.

A control sample and a treated sample were sent to an independent laboratory for percent total sulfur testing (Method ASTM D129). The laboratory reported that the untreated control sample contained 2.3% total sulfur and the treated sample contained 1.7% total sulfur. This is a reduction of approximately 26% of the total initial sulfur content.

Example 2, Trial 2

A different sample of crude oil was treated in a similar fashion for the same time period. At the end of the time period, the Control sample contained 4.8% total sulfur whereas the Treated sample contained only 3.45% total sulfur.

Example 3

Application of the above described method for two crude oil samples gave a reduction of 0.6–0.7% of the total sulfur content of both samples over a 2 week period as seen in the data below. This similar total reduction amount occurred in both samples even though Sample 1 had a higher initial sulfur concentration than Sample 2 (3.9% vs. 2.3%).

| | % total sulfur |
|---|---|
| Sample 1. | |
| a. Untreated oil | 3.9% |
| b. Oil treated for 14 days | 3.2% |
| Sample 2. | |
| a. Untreated oil | 2.3% |
| b. Treated oil | 1.7% |

Sulfur content of the residual crude oil was determined by ASTM Method D129.

The above description is for the purpose of teaching the person of ordinary skill in the art how to practice the present invention, and it is not intended to detail all those obvious modifications and variations of it which will become apparent to the skilled worker upon reading the description. The examples presented herein are illustrative of the present invention and should not be construed as limiting. For those well versed in this technology, other embodiments and wider applications within the scope and spirit of this invention may come to mind. It is intended, however, that all such obvious embodiments, modifications, applications and variations be included within the scope and spirit of the present invention described in this disclosure and the following claims.

The invention claimed is:

1. A method for biologically desulfurizing sulfur containing hydrocarbon fuel without an unacceptable loss in fossil fuel value comprising the use of an aqueous biocatalytic agent having the ability to metabolize sulfur compounds without additional nutrients wherein a. said biocatalytic agent has the ability to oxidize pyritic sulfur compounds, the ability to cleave carbon-sulfur bonds, or combinations thereof, and are viable microbial agents selected from the group consisting of non-growing microbes, minimally growing microbes, and combinations thereof; wherein b. said sulfur compounds are selected from the group consisting of pyritic sulfur, and combinations of pyritic sulfur and organic sulfur compounds; wherein c. said microbial agents do not utilize the carbon skeleton of said hydrocarbon fuel for energy and do not utilize said carbon skeleton of said hydrocarbon fuel as a source of carbon.

2. The method of claim 1 wherein said sulfur containing hydrocarbon fuel is selected from the group consisting of fossil fuel petroleum liquids, petroleum products, oil, coal, coal-water, coal tar, coal products, and synthetic hydrocarbon fuel.

3. The method of claim 1 wherein said microbial agents are used at a concentration in the range of $1\times10^8$ or $1\times10^9$ cells per ml of each organism.

4. The method of claim 1 wherein said microbial agents are selected from the group consisting of bacteria, fungi, yeast, and algae.

5. The method of claim 1 wherein said microbial agents are viable bacterial agents selected from the group consisting of bacteria that are not growing and bacteria showing minimal growth.

6. The method of claim 1 further comprising passing an aqueous suspension of said microbial agents through said sulfur containing hydrocarbon fuel by gravity flow.

7. The method of claim 1 further comprising passing an aqueous suspension of said microbial agents through said sulfur containing hydrocarbon fuel by pressure flow.

8. The method of claim 6 wherein said suspension is in the form of droplets.

9. The method of claim 7 wherein said suspension is in the form of droplets.

10. The method of claim 1 wherein said sulfur containing hydrocarbon fuel maintains a fuel value that does not change during said desulfurizing.

11. The method of claim 1 further comprising the use of microbial agents that oxidize said pyritic sulfur compounds and do not use the resultant energy for growth.

12. The method of claim 1 further comprising the use of microbial agents that catabolize said organic sulfur compounds and do not use the resultant energy for growth.

13. The method of claim 1 further comprising removal of water soluble sulfur compounds and sulfur compounds produced by said ability to metabolize sulfur compounds of said biocatalytic agent wherein said removal is by flowing water through said sulfur containing hydrocarbon fuel.

14. The method of claim 13 wherein said water is in the form of droplets.

15. The method of claim 10 wherein said microbial agents do not degrade the carbon skeleton of carbon-sulfur compounds and do transform said skeleton into another molecule that still has fuel value.

16. The method of claim 1 wherein said method does not require constant mechanical stirring.

17. The method of claim 1 wherein said method is applied to a fuel system at a well head without the need for special equipment and before being piped to a refinery process.

18. The method of claim 1 wherein said method is applied to treat petroleum products in oil tankers at the point of origin of the tanker trip and provides effective desulfurizing during said tanker trip.

19. The method of claim 1 wherein said method does not require a subsequent need for breaking the resulting emulsion.

20. The method of claim 1 wherein said sulfur containing hydrocarbon fuel is a coal fuel and wherein said biocatalytic agent can be applied to the coal fuel within the system of a coal mine without the need for special equipment and before said coal fuel is shipped away.

21. A method for biologically desulfurizing sulfur containing hydrocarbon fuel comprising the use of an aqueous biocatalytic agent having the ability to metabolize sulfur compounds without additional nutrients wherein a. said biocatalytic agent has the ability to oxidize pyritic sulfur compounds and the ability to cleave carbon-sulfur bonds and are viable microbial agents selected from the group consisting of non-growing microbes, minimally growing microbes, and combinations thereof; wherein b. said sulfur compounds are selected from the group consisting of pyritic sulfur, organic sulfur, and combinations of pyritic and organic sulfur compounds; and c. wherein said microbial agents do not utilize the carbon skeleton of said hydrocarbon fuel for energy and do not utilize said carbon skeleton of said hydrocarbon fuel as a source of carbon.

22. The method of claim 21 wherein said sulfur containing hydrocarbon fuel is selected from the group consisting of fossil fuel, petroleum liquids, petroleum products, oil, coal, coal-water, coal tar, coal products, and synthetic hydrocarbon fuel.

23. The method of claim 21 wherein said microbial agents are used at a concentration in the range of $1\times10^8$ or $1\times10^9$ cells per ml of each organism.

24. The method of claim 21 wherein said microbial agents are selected from the group consisting of bacteria, fungi, yeast, and algae.

25. The method of claim 21 wherein said microbial agents are viable bacterial agents selected from the group consisting of bacteria that are not growing and bacteria showing minimal growth.

26. The method of claim 21 further comprising passing an aqueous suspension of said microbial agents through said sulfur containing hydrocarbon fuel by gravity flow.

27. The method of claim 21 further comprising passing an aqueous suspension of said microbial agents through said sulfur containing hydrocarbon fuel by pressure flow.

28. The method of claim 26 wherein said suspension is in the form of droplets.

29. The method of claim 27 wherein said suspension is in the form of droplets.

30. The method of claim 21 wherein said microbial agents do not utilize the carbon skeleton of said hydrocarbon fuel for energy and do not utilize said carbon skeleton of said hydrocarbon fuel as a source of carbon.

31. The method of claim 21 wherein said sulfur containing hydrocarbon fuel maintains a fuel value that does not change during said desulfurizing.

32. The method of claim 21 further comprising the use of microbial agents that oxidize said pyritic sulfur compounds and do not use the resultant energy for growth.

33. The method of claim 21 further comprising the use of microbial agents that catabolize said organic sulfur compounds and do not use the resultant energy for growth.

34. The method of claim 21 further comprising removal of water soluble sulfur compounds and sulfur compounds produced by said ability to metabolize sulfur compounds of said biocatalytic agent wherein said removal is by flowing water through said sulfur containing hydrocarbon fuel.

35. The method of claim 34 wherein said water is in the form of droplets.

36. The method of claim 31 wherein said microbial agents do not degrade the carbon skeleton of carbon compounds and do transform said skeleton into another molecule that still has fuel value.

37. The method of claim 21 wherein said method does not require constant mechanical stirring.

38. The method of claim 21 wherein said method is applied to a fuel system at a well head without the need for special equipment and before being piped to a refinery process.

39. The method of claim 21 wherein said method is applied to treat petroleum products in oil tankers at the point of origin of the tanker trip and provides effective desulfurizing during said tanker trip.

40. The method of claim 21 wherein said method does not require a subsequent need for breaking the resulting emulsion.

41. The method of claim 21 wherein said sulfur containing hydrocarbon fuel is a coal fuel and wherein said biocatalytic agent can be applied to the system at a coal mine without the need for special equipment and before said coal fuel is shipped away.

42. A method for biologically desulfurizing sulfur containing hydrocarbon fuel without an unacceptable loss in fossil fuel value comprising the use of an aqueous biocatalytic agent having the ability to metabolize sulfur compounds without additional nutrients wherein a. said biocatalytic agent has the ability to oxidize pyritic sulfur compounds, the ability to cleave carbon-sulfur bonds, or combinations thereof, and are viable microbial agents selected from the group consisting of non-growing microbes, minimally growing microbes, and combinations thereof; wherein b. said sulfur compounds are selected from the group consisting of pyritic sulfur, organic sulfur, and combinations of pyritic sulfur and organic sulfur compounds; wherein c. said sulfur containing hydrocarbon fuel is not mechanically emulsified during said desulfurizing; and wherein d. said microbial agents do not utilize the carbon skeleton of said hydrocarbon fuel for energy and do not utilize said carbon skeleton of said hydrocarbon fuel as a source of carbon.

* * * * *